US007690743B2

(12) United States Patent
Kim et al.

(10) Patent No.: US 7,690,743 B2
(45) Date of Patent: Apr. 6, 2010

(54) NOZZLE DRIVE CONTROL DEVICE AND METHOD

(75) Inventors: Sung-wook Kim, Suwon-si (KR); Byung-hun Kim, Hwaseong-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 424 days.

(21) Appl. No.: 11/653,370

(22) Filed: Jan. 16, 2007

(65) Prior Publication Data

US 2007/0182773 A1 Aug. 9, 2007

(30) Foreign Application Priority Data

Feb. 6, 2006 (KR) ..... 10-2006-0011201

(51) Int. Cl.
*B41J 29/38* (2006.01)

(52) U.S. Cl. ..... 347/10; 347/19

(58) Field of Classification Search ..... None
See application file for complete search history.

(56) References Cited

U.S. PATENT DOCUMENTS

2006/0012624 A1* 1/2006 Vanhooydonck ..... 347/15
2006/0033768 A1* 2/2006 Uraki et al. ..... 347/14
2006/0187253 A1* 8/2006 Sato et al. ..... 347/15

FOREIGN PATENT DOCUMENTS

JP 2003-191467 7/2003

* cited by examiner

*Primary Examiner*—Matthew Luu
*Assistant Examiner*—Justin Seo
(74) *Attorney, Agent, or Firm*—Stanzione & Kim, LLP

(57) ABSTRACT

A nozzle drive control device and method includes applying a drive voltage to a nozzle, sensing a size or speed of an ink droplet ejected by the applied drive voltage, determining whether the sensed result is included within a predetermined range, and calculating the drive voltage to eject an ink droplet when the sensed size or ejecting speed of the ejected ink droplet is not included within the predetermined range.

18 Claims, 5 Drawing Sheets

NOZZLE DRIVE CONTROL DEVICE AND METHOD

CROSS-REFERENCE TO RELATED APPLICATIONS

This application claims priority under 35 U.S.C. §119(a) from Korean Patent Application No. 10-2006-0011201, filed on Feb. 6, 2006, in the Korean Intellectual Property Office, the disclosure of which is incorporated herein in its entirety by reference.

BACKGROUND OF THE INVENTION

1. Field of the Invention

The present general inventive concept relates to an image forming apparatus such as a printer, a facsimile, or a multi function peripheral, and more particularly, to an inkjet type image forming apparatus which ejects ink droplets to a print medium from a plurality of nozzles included in a print head.

2. Description of the Related Art

An inkjet type image forming apparatus has to accurately control a size and a speed of an ink droplet ejected from a nozzle. The size and speed of the ink droplet are generally determined by controlling factors related to a time when a drive voltage to eject the ink droplet is applied.

However, as illustrated in FIGS. 1A and 1B, since variation rates of the size (ρL) and the speed of the ink droplet (m/s) are non-linear with respect to a factor of a drive waveform, such as a pulse width (us), it is difficult to extract the factor of the drive waveform to control the size and the speed of the ink droplet. Here, V represents a voltage of the ink droplet. Although a factor of a square waveform may be extracted as a factor of the drive wave form, since the variation rates of the size and the speed of the ink droplet with respect to the factor of the square waveform are different for each nozzle, the variation rates of the size and the speed of the ink droplet with respect to the factor for all the nozzles have to be measured so as to control the size and the speed of the ink droplet ejected by every nozzle in a print head including a plurality of nozzles.

In addition, since the factor of the square waveform is different dependent on a nature of the ejected ink and a status of the print head, the square waveform factor has to be recognized before measuring and controlling the variation rates of the size and the speed of the ink droplet ejected from each nozzle. Therefore, when the size and the speed of the ink droplet are varied dependent on the nature of the ink and the status of the print head, it is difficult to examine the print head so as to maintain a constant size and speed of the ejected ink droplet.

SUMMARY OF THE INVENTION

The present general inventive concept provides a method and a device to control a size and a speed of an ink droplet ejected from a nozzle by repeatedly calculating and controlling a drive voltage according to a linear relationship between the drive voltage and variation rates of the size and the speed of the ink droplet.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept are achieved by providing a nozzle drive control method including applying a drive voltage to a nozzle to eject an ink droplet, sensing a size or an ejecting speed of the ejected ink droplet, determining whether the sensed size or ejecting speed of the ink droplet is included within a predetermined range, and calculating a second drive voltage as the drive voltage when the sensed size or ejecting speed of the ink droplet is not included within the predetermined range, to apply the second drive voltage to the nozzles to eject a second ink droplet, to sense a second size or second ejecting speed of the second ink droplet as the size or ejecting speed, and to determine whether the size or ejection speed of the second ink droplet is included within the predetermined range.

The calculating of the second drive voltage may include repeating the calculating the second drive voltage as the drive voltage until the sensed result is included within the predetermined range.

The calculating of the drive voltage may include calculating the second drive voltage according to a determination that variation rates of the size and the ejecting speed of the ink droplet and the second size and ejecting speed of the second ink droplet ejected from the nozzle are linear with respect to the applied drive voltage.

The calculating of the second drive voltage may include calculating the second drive voltage using the following equation:

$$V_{new}=V_{old}+(Q_{target}-Q_{sensed})/a$$

where $V_{new}$ is the new drive voltage to be calculated, $V_{old}$ is the previously applied drive voltage, $Q_{target}$ is a predetermined size or ejecting speed of the ink droplet, $Q_{sensed}$ is the sensed size or ejecting speed of the ink droplet, and a is a predetermined slope.

$Q_{target}$ may be the predetermined size of the ink droplet and $Q_{sensed}$ may be the sensed size of the ink droplet.

$Q_{target}$ may be the predetermined ejecting speed of the ink droplet and $Q_{sensed}$ may be the sensed ejecting speed of the ink droplet.

The calculating of the second drive voltage may include calculating the second drive voltage using a Newton-Rhapson method, false-position method, or a bisection method.

The determining of whether the sensed size or ejecting speed of the ink droplet is included within the predetermined range may include using predetermined ranges corresponding to respective nozzles in an image forming apparatus having a plurality of nozzles.

The method may further include applying another drive voltage to another nozzle to eject another ink droplet, sensing another size or ejecting speed of the another ink droplet ejected by the another nozzle, determining whether the sensed size or ejecting speed of the another ink droplet ejected by the another nozzle is included within another predetermined range, and calculating a third drive voltage as the another drive voltage when the sensed size or ejecting speed of the another ink droplet ejected by the another nozzle is not included within the another predetermined range, to apply the third drive voltage to the another nozzle to eject a second another ink droplet, to sense a second another size or ejecting speed of the second another ink droplet ejected from the second nozzle as the another size or ejecting speed of the ink droplet ejected by the another nozzle, and to determine whether the size or ejection speed of the second another ink droplet ejected by the another nozzle is included within the another predetermined range.

The method may also include storing the applied drive voltage for the nozzle when it is determined that the sensed size or ejecting speed of the ink droplet ejected is included within the predetermined range.

The method may also include controlling the nozzle by the stored drive voltage when performing a print job.

The foregoing and/or other aspects and utilities of the present general inventive concept are also achieved by providing a computer-readable recording medium having embodied thereon a computer program for executing a nozzle drive control method, the method including applying a drive voltage to a nozzle to eject an ink droplet, sensing a size or an ejecting speed of the ejected ink droplet, determining whether the sensed size or ejecting speed of the ink droplet is included within a predetermined range, and calculating a second drive voltage as the drive voltage when the sensed size or ejecting speed of the ejected ink droplet is not included within the predetermined range, to apply the second drive voltage to the nozzles to eject a second ink droplet, to sense a second size or second ejecting speed of the second ink droplet as the size or ejecting speed, and to determine whether the size or ejection speed of the second ink droplet is included within the predetermined range.

The foregoing and/or other aspects and utilities of the present general inventive concept are also achieved by providing a nozzle drive control device including a power supply to apply a drive voltage to a nozzle to eject an ink droplet, an ink droplet sensor to sense a size or an ejecting speed of the ejected ink droplet, a determiner to determine whether the sensed size or ejecting speed of the ejected ink droplet is included within a predetermined range, and a controller to calculate a second drive voltage as the drive voltage when the determiner determines that the sensed size or ejecting speed of the ejected ink droplet is not included within the predetermined range and to repeatedly control the power supply, the ink droplet sensor, and the determiner to apply the second drive voltage to the nozzle to eject a second ink droplet, to sense a second size or ejection speed of the second ink droplet, and to determiner whether the size or ejection speed of the second ink droplet is included within the predetermined range, respectively.

The controller may control the power supply, the ink droplet sensor, and the determiner repeatedly until the determiner determines that the sensed size or ejecting speed of the ejected droplet is included within the predetermined range.

The controller may include a voltage calculator to calculate the second drive voltage to be applied to the nozzle using the sensed size or ejecting speed of the ejected ink droplet, and a repetition controller to repeatedly control the power supply, the ink droplet sensor, and the determiner in accordance with the calculated second drive voltage.

The voltage calculator may calculate the second drive voltage according to a determination that variation rates of the size and the ejecting speed of the ink droplet and the second size and ejecting speed of the second ink droplet ejected from the nozzle are linear with respect to the applied drive voltage.

The voltage calculator may calculate the second drive voltage using the following equation:

$$V_{new}=V_{old}+(Q_{target}-Q_{sensed})/a$$

where $V_{new}$ is a drive new voltage to be calculated, $V_{old}$ is the previously applied drive voltage, $Q_{target}$ is a predetermined size or ejecting speed of the ink droplet, $Q_{sensed}$ is the sensed size or ejecting speed of the ink droplet, and a is a predetermined slope.

The voltage calculator may calculate the second drive voltage using a Newton-Rhapson method, false-position method, or a bisection method.

The determiner may include predetermined ranges corresponding to respective nozzles in an image forming apparatus having a plurality of nozzles.

The device may also include a drive voltage storage unit to store the applied drive voltage for the nozzle when the determiner determines that the sensed size or ejecting speed of the ejected ink droplet is within the predetermined range.

The device may also include a nozzle controller to control the nozzle by the stored drive voltage when performing a print job.

The foregoing and/or other aspects and utilities of the present general inventive concept are also achieved by providing a method to control a nozzle, the method including applying a drive voltage to the nozzle to eject an ink droplet, detecting a size or an ejecting speed of the ejected ink droplet, determining whether the size or ejecting speed of the ejected ink droplet is within a predetermined range, and calculating a new drive voltage as the drive voltage to apply to the nozzle when the determined size or ejecting speed of the ejected ink droplet is not within the predetermined range, and repeating the applying of the drive voltage, the detecting a size or ejection speed, and the determining of whether the size or ejection speed of the ejected ink droplet is within the predetermined range until the detected size or ejection speed is within the predetermined range.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
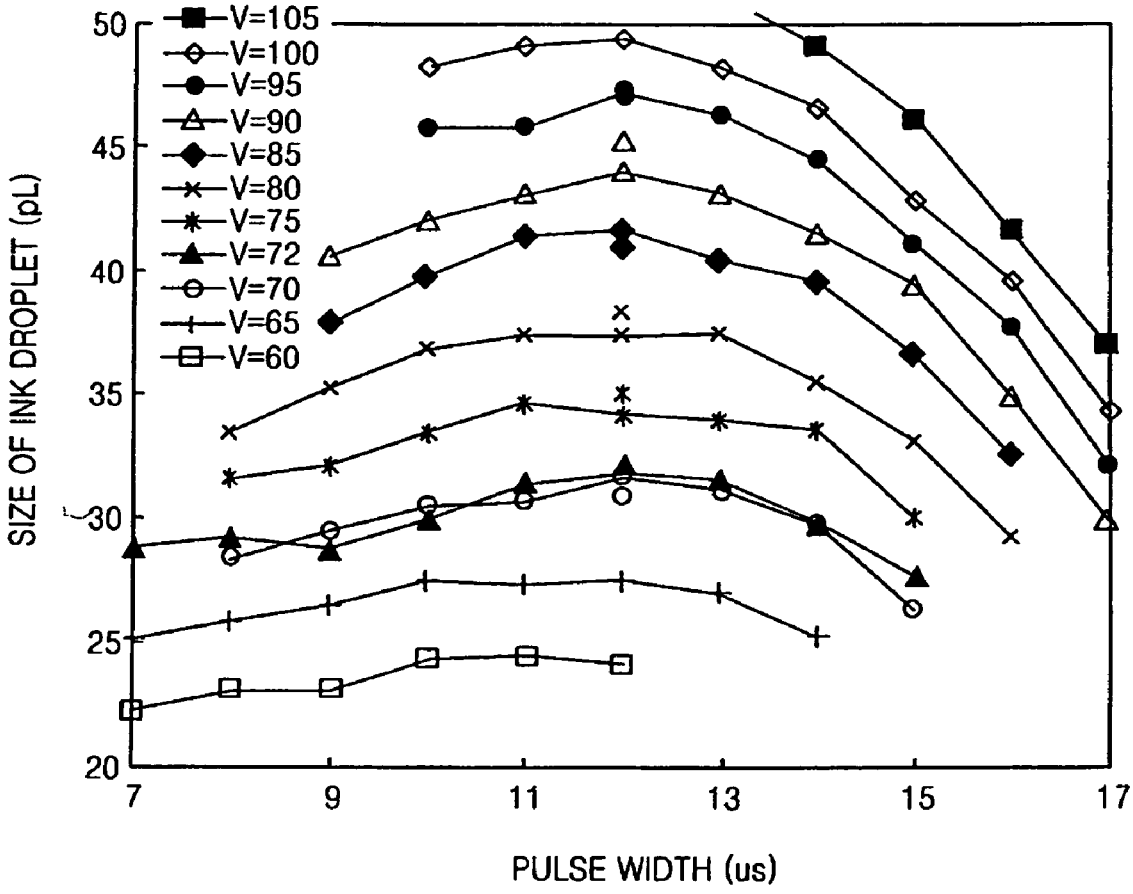
FIG. 1*a* is a graph illustrating a size of an ink droplet ejected from a nozzle versus a pulse width.
Figure 1B:
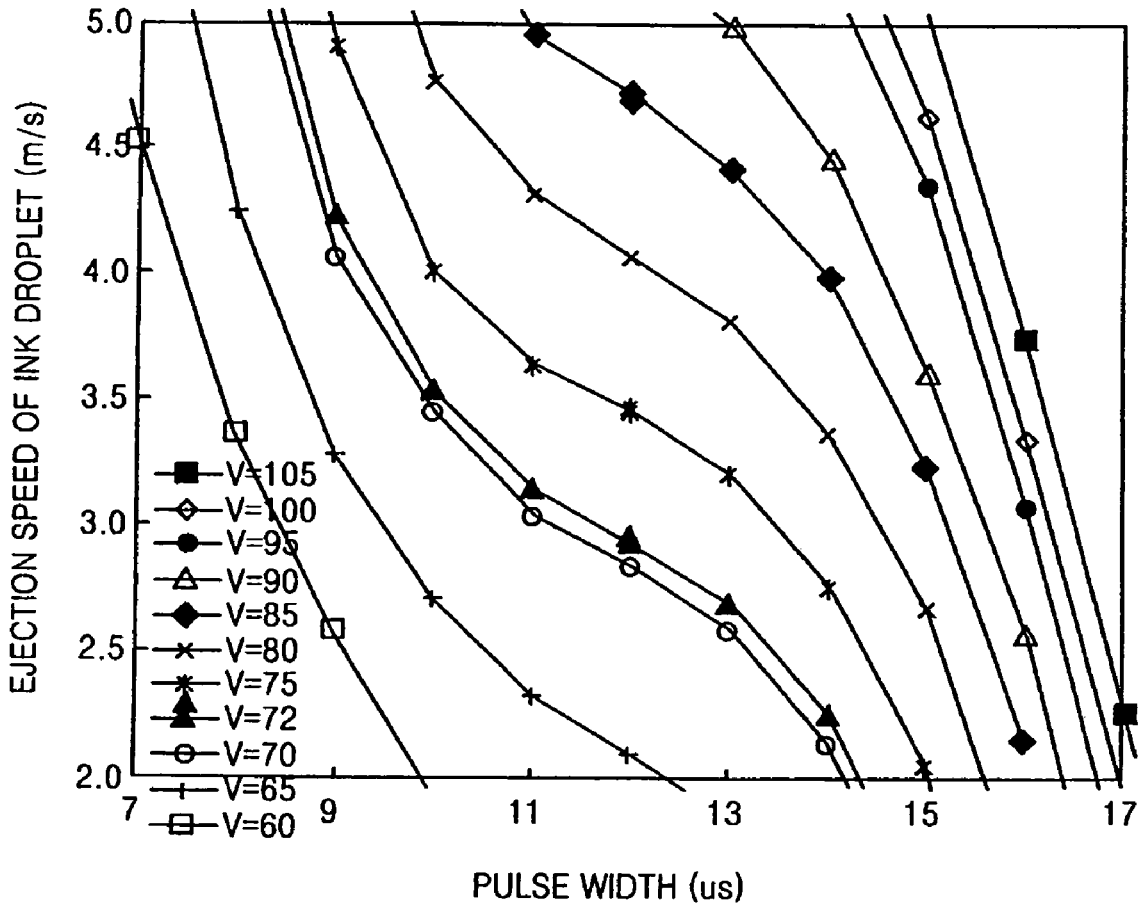
FIG. 1*b* is a graph illustrating a speed of an ink droplet ejected from a nozzle versus a pulse width.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
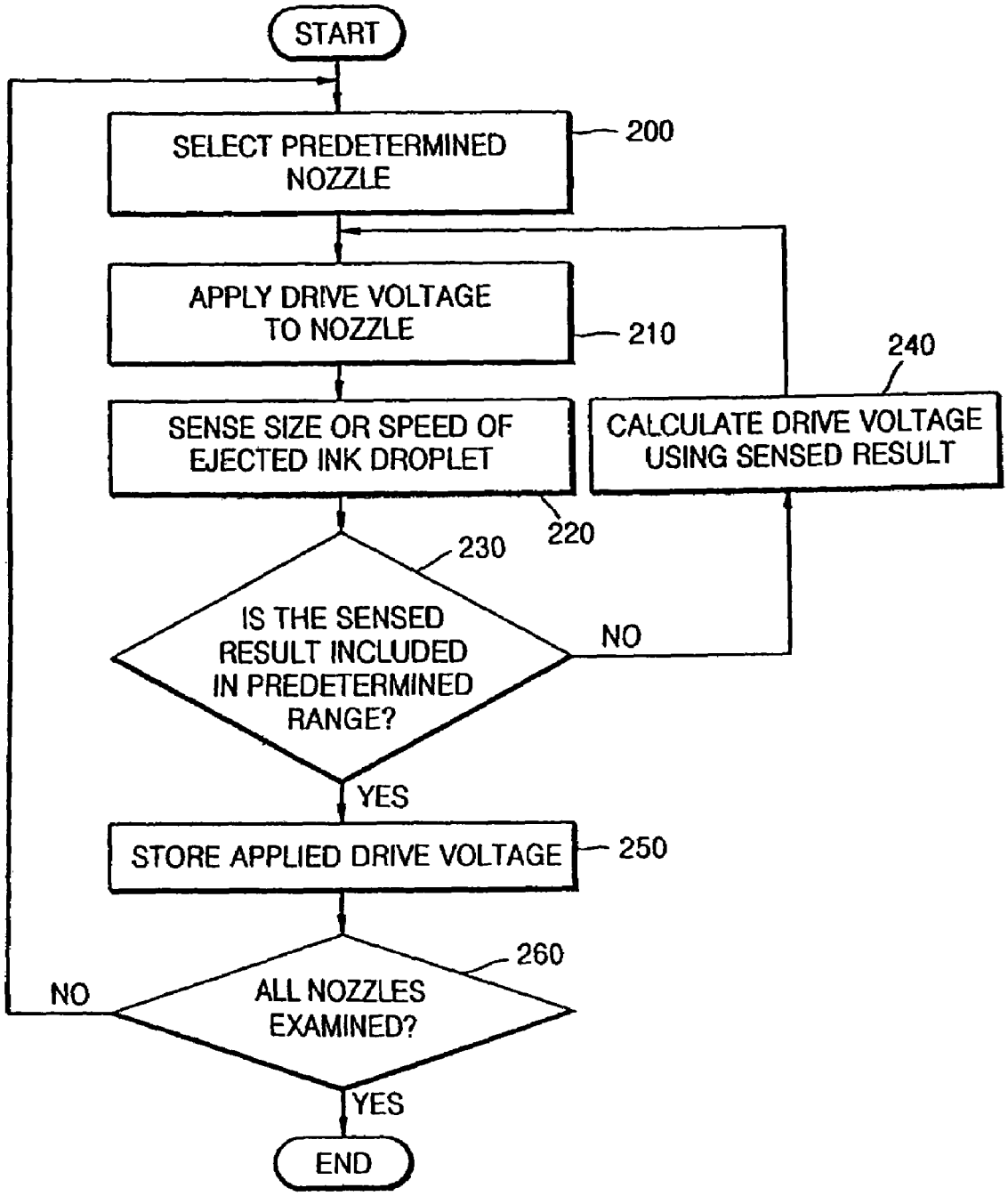
FIG. 2 is a flowchart illustrating a nozzle drive control method according to an embodiment of the present general inventive concept.

FIG. 2 is a flowchart illustrating a nozzle drive control method according to an embodiment of the present general inventive concept.

First, a nozzle $N_n$ is selected from a plurality of nozzles of a print head of an image forming apparatus (operation 200). The nozzle $N_n$ selected in operation 200 is a nozzle to control a size of an ejected ink droplet (or an ejection speed S of the ink droplet), where n is a number allocated to each nozzle.

A predetermined initial drive voltage $V_{n,0}$ is applied so as to eject an ink droplet from the nozzle $N_n$ selected in operation 200 (operation 210).

A size $Q_{n,i}$ of the ink droplet (or an ejection speed $S_{n,i}$ of the ink droplet) ejected from the nozzle $N_n$ by the initial drive voltage $V_{n,0}$ applied in operation 210 is sensed through a sensor (operation 220). Here, i denotes a number of times of examination of the nozzle. The sensor may be installed adjacent to the print head of the image forming apparatus to generate a sensed signal representing the size or the ejection speed.

Then, it is determined whether the size $Q_{n,i}$ of the ink droplet (or the ejection speed $S_{n,i}$ of the ink droplet) sensed as the sensed signal in operation 220 is included within a predetermined control range, such as a control range defined under Equation 1 or Equation 2, in operation 230. The control range can be set up for each nozzle by the print environments or can be set by a user.

$$\Delta Q_{n,i}=|Q_{n,i\text{-}target}-Q_{n,i}|<\xi Q \quad \text{[Equation 1]}$$

where $\Delta Q_{n,i}$ is an error between an actual size of the ejected ink droplet and a target size of the ink droplet, $Q_{n,i\text{-}target}$ is the target size of the ink droplet to be controlled with respect to the nozzle $N_n$, $Q_{n,i}$ is the size of the ink droplet sensed in operation 220, and $\xi$ and Q are constants.

$$\Delta S_{n,i}=|S_{n,i\text{-}target}-S_{n,i}|<\xi S \quad \text{[Equation 2]}$$

where $\Delta S_{n,i}$ is an error between an actual speed of the ejected ink droplet and a target speed of the ink droplet, $S_{n,i\text{-}target}$ is the target speed of the ink droplet to be controlled with respect to the nozzle $N_n$, $S_{n,i}$ is the speed of the ink droplet sensed in operation 220, and $\xi$ and S are constants.

When it is determined that the size $Q_{n,i}$ of the ink droplet (or the ejection speed $S_{n,i}$ of the ink droplet) sensed in operation 220 is not included within the control range in operation 230, a new drive voltage to be applied to drive the nozzle $N_n$ can be calculated using the size $Q_{n,i}$ of the ink droplet (or the ejection speed $S_{n,i}$ of the ink droplet) in the following methods.

First, the new drive voltage may be calculated on the assumption that the variation rates of the size and the speed of the ink droplet ejected from the nozzle are linear with respect to the drive voltage applied to drive the nozzle. While the variation rates of the size and the speed of the ejected ink droplet may not be linear with respect to a drive voltage applied like a curve 400 illustrated in FIG. 4, the new drive voltage to be applied may be calculated by Equation 3 on an assumption that the variation rates of the size and the speed of the ink droplet ejected from the nozzle are linear with respect to the drive voltage applied in operation 240.

$$V_{n,i+1}=V_{n,i}+\Delta Q_{n,i}/a \quad \text{[Equation 3]}$$

where $V_{n,i+1}$ is the new (i+1)-th drive voltage to be applied and to be calculated in operation 240, $V_{n,i}$ is the i-th drive voltage which was previously calculated and applied, and a is a predetermined slope.

Second, the new (i+1)-th drive voltage $V_{n,i+1}$ needed to drive the nozzle can also be calculated using a mathematical method such as a Newton-Rhapson method, false-position method, or a bisection method which reduces an error by repeatedly performing operations.

After operation 240, the new drive voltage $V_{n,i+1}$ calculated in operation 240 is applied so as to eject the ink droplet from the nozzle $N_n$ (operation 210).

As illustrated in the flowchart of FIG. 2, operations 210 to 240 may be performed repeatedly until the size $Q_{n,i}$ of the ink droplet (or the ejection speed $S_{n,i}$ of the ink droplet) sensed in operation 220 is included within the predetermined range.

Figure 4:
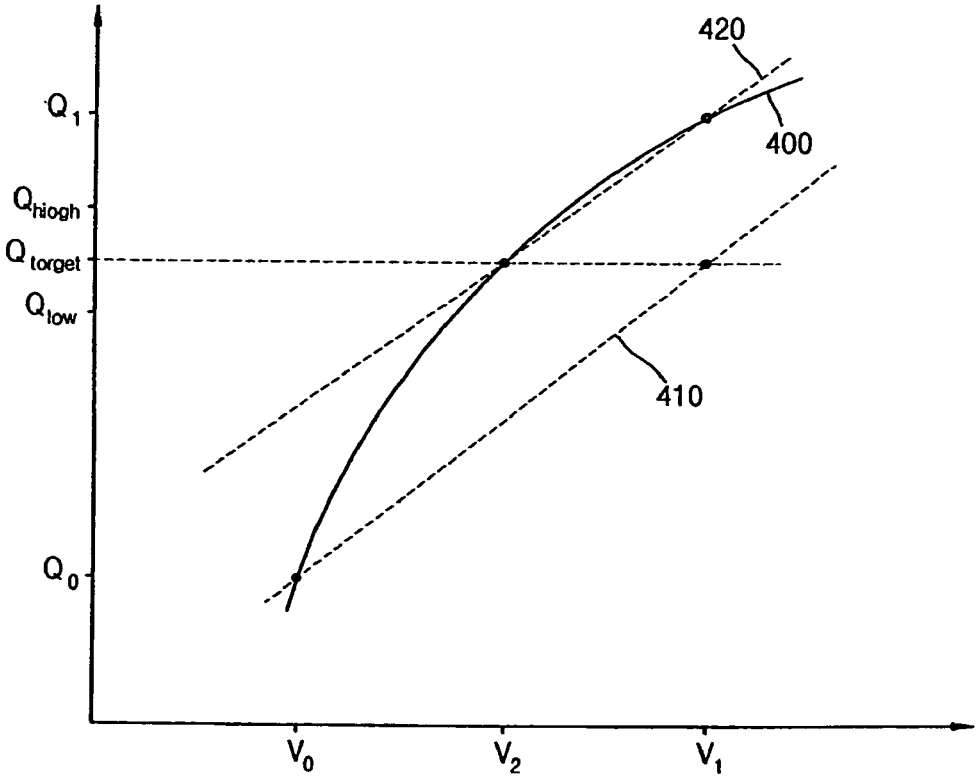
FIG. 4 is a graph illustrating a nozzle drive control device and method according to the present general inventive concept.

For example, referring to FIGS. 2 and 4, when an initial drive voltage $V_0$ is applied in operation 210 and a size of the ink droplet is sensed as $Q_0$ in operation 220, a new drive voltage $V_1$ corresponding to the target size of the ink droplet $Q_{target}$ is calculated in operation 240 on the assumption that the size variation of the ink droplet ejected from the nozzle is linear in with respect to the initial drive voltage, and has a slope same as a slope of a line 410 of FIG. 4. However, since in practice, the relationship between the size of the ink droplet ejected from the nozzle and the drive voltage may be the curve 400, when the drive voltage $V_1$ calculated in operation 240 is applied in operation 210, a target ink droplet having the target size of the ink droplet $Q_{target}$ may not be ejected, but a size of the ink droplet corresponding to the ejected ink droplet $Q_1$ due to the drive voltage $V_1$ is sensed in operation 220. If it is determined that the size of the ink droplet $Q_1$ sensed in operation 220 is not included within a predetermined control range from $Q_{low}$ to $Q_{high}$ in operation 230, then a new drive voltage $V_2$ corresponding to the target size of the ink droplet $Q_{target}$ is repeatedly calculated on the assumption that the size of the ink droplet ejected from the nozzle is linear with respect to the drive voltage, and has a slope the same as a slope of line 420 of FIG. 4. Since in practice, the relationship between the size of the ink droplet ejected from the nozzle and the drive voltage may be the curve 400, when the drive voltage $V_2$ calculated in operation 240 is applied in operation 210, an ink droplet of a size approximately corresponding to $Q_{target}$ is ejected and sensed in operation 220, and the size of the ink droplet is included within the predetermined control range from $Q_{low}$ to $Q_{high}$.

As described above, while the variation rate of the size of the ink droplet may be non-linear with respect to the drive voltage, the operations illustrated in FIG. 2 are performed repeatedly on the assumption that the relationship is linear and has a slope like the lines 410 and 420 of FIG. 4.

When it is determined that a size $Q_{n,i}$ of the ink droplet (or an ejection speed $S_{n,i}$ of the ink droplet) sensed in operation 220 is included within the predetermined control range in operation 230, the value of a drive voltage $V_{n,i}$ applied in operation 210 is stored in a storage medium in correspondence with the nozzle $N_n$ (operation 250).

After operation 250, it is determined whether all the nozzles have been examined (operation 260).

If it is determined that there remain nozzles to be examined, a nozzle $N_{n+1}$ corresponding to the (n+1)-th nozzle is selected in operation 200.

In addition, when the nozzle is examined according to the nozzle drive control method of the present general inventive concept and a print job is performed, the ink droplet is ejected to the print medium and printed by applying the drive voltage stored with respect to each nozzle in operation 250.

Figure 3:
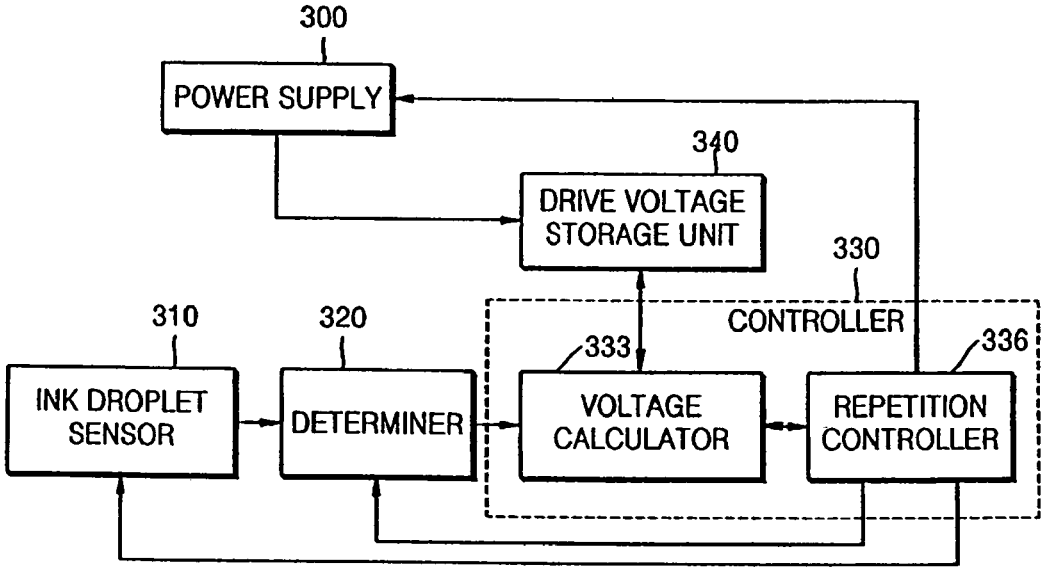
FIG. 3 is a block diagram illustrating a nozzle drive control device usable in an image forming apparatus according to an embodiment of the present general inventive concept.

FIG. 3 is a block diagram illustrating a nozzle drive control device usable in an image forming apparatus according to an embodiment of the present general inventive concept. The nozzle drive control device includes a power supply 300, an ink droplet sensor 310, a determiner 320, a controller 330, and a drive voltage storage unit 340. The controller 330 may include a voltage calculator 222 and a repetition controller 336.

The drive voltage $V_{n,i}$ to eject the ink droplet from the nozzle $N_n$ among the plurality of nozzles included in the print head of the image forming apparatus is applied by the power supply 300. Here, n is a number allocated to each nozzle, and i denotes a number of times of examination of the nozzle. A predetermined initial drive voltage $V_{n,0}$ is applied by the power supply 300, and a drive voltage $V_{n,i}$ calculated by the voltage calculator 333 is applied at the i-th time.

The ink droplet sensor 310 senses a size $Q_{n,i}$ of the ink droplet (or the ejection speed $S_{n,i}$ of the ink droplet) ejected from the nozzle $N_n$ by the initial drive voltage $V_{n,0}$ applied by the power supply 300. Since the ink droplet sensor 310 is well know, detailed operations and structures thereof will be omitted.

The determiner determines whether the size $Q_{n,i}$ of the ink droplet (or the ejection speed $S_{n,i}$ of the ink droplet) sensed by the ink droplet sensor is included within a predetermined control range, such as a control range defined under Equation 4 or Equation 5. Here, the control range can be set up for each nozzle by the print environments or can be set by a user's setting.

$$\Delta Q_{n,i}=|Q_{n,i\text{-}target}-Q_{n,i}|<\xi Q \quad \text{[Equation 4]}$$

where $\Delta Q_{n,i}$ is an error between an actual size of the ejected ink droplet and a target size of the ink droplet, $Q_{n,i\text{-}target}$ is the target size of the ink droplet to be controlled with respect to the nozzle $N_n$, $Q_{n,i}$ is the size of the ink droplet sensed by the ink droplet sensor 310, and $\xi$ and Q are constants.

$$\Delta S_{n,i}=|S_{n,i\text{-}target}-S_{n,i}|<\xi S \quad \text{[Equation 5]}$$

where $\Delta S_{n,i}$ is an error between an actual speed of the ejected ink droplet to be controlled and a target speed of the ink droplet, $S_{n,i\text{-}target}$ is the target speed of the ink droplet to be controlled with respect to the nozzle $N_n$, $S_{n,i}$ is the speed of the ink droplet sensed by the ink droplet sensor 310, and $\xi$ and S are constants.

The controller 330 calculates the drive voltage $V_{n,i}$ to be applied to the nozzle $N_n$ using the result sensed by the ink droplet sensor 310 in response to the result determined by the determiner 320, and repeatedly controls the power supply 300, the ink droplet sensor 310, and the determiner 320 in accordance with the calculated drive voltage $V_{n,i}$.

When the determiner 320 determines that the size $Q_{n,i}$ of the ink droplet (or the ejection speed $S_{n,i}$ of the ink droplet) sensed by the ink droplet sensor 310 is not included within the control range, the voltage calculator 333 calculates a new drive voltage to be applied to drive the nozzle $N_n$ using the size $Q_{n,i}$ of the ink droplet (or the ejection speed $S_{n,i}$ of the ink droplet) by the following methods.

First, and in reference with FIGS. 2 and 4, the new drive voltage may be calculated on the assumption that the variation rates of the size and the speed of the ink droplet ejected from the nozzle are linear with respect to the drive voltage applied to drive the nozzle. While the variation rates of the size and the speed of the ejected ink droplet may not be linear with respect to a drive voltage applied like a curve 400 illustrated in FIG. 4, a new drive voltage to be applied may be calculated by Equation 6 on the assumption that the variation rates of the size and the speed of the ink droplet ejected from the nozzle are linear with respect to the drive voltage applied in operation 240.

$$V_{n,i+1}=V_{n,i}+\Delta Q_{n,i}/a \quad \text{[Equation 6]}$$

where $V_{n,i+1}$ is the new (i+1)-th drive voltage to be applied and to be calculated in operation 240, $V_{n,i}$ is the i-th drive voltage which was previously calculated and applied, and a is a predetermined slope.

Second, the new (i+1)-th drive voltage $V_{n,i+1}$ needed to drive the nozzle can also be calculated using a mathematical method such as a Newton-Rhapson method, false-position method, or a bisection method which reduces an error by repeatedly performing operations.

The repetition controller 336 repeatedly controls the power supply 300, the ink droplet sensor 310, and the determiner 320 in accordance with the drive voltage $V_{n,i}$ calculated by the voltage calculator 333. The repetition controller 336 controls the operations to be performed repeatedly by sequentially increasing i until the size $Q_{n,i}$ of the ink droplet (or the ejection speed $S_{n,i}$ of the ink droplet) sensed in operation 220 is included in the predetermined range.

For example, referring to FIGS. 2 and 4, when an initial drive voltage $V_0$ is applied by the power supply 300 and a size of the ink droplet is sensed by the ink droplet sensor 310 as $Q_0$, the voltage calculator 333 calculates a new drive voltage $V_1$ corresponding to the target size of the ink droplet $Q_{target}$ on the assumption that the size variation of the ink droplet ejected from the nozzle is linear with respect to the initial drive voltage, and has a slope same as a slope of a line 410 of FIG. 4. However, since in practice, the relationship between the size of the ink droplet ejected from the nozzle and the drive voltage may be a curve 400, when the drive voltage $V_1$ calculated by the voltage calculator is applied by the power supply 300, the target ink droplet corresponding to $Q_{target}$ may not be ejected, but a size of the ink droplet corresponding to the ejected ink $Q_1$ due to the drive voltage $V_1$ is sensed by the ink droplet sensor 310. If the determiner determines that the size of the ink droplet $Q_1$ sensed by the ink droplet sensor 310 is not included within a predetermined control range from $Q_{low}$ to $Q_{high}$, then a new drive voltage $V_2$ corresponding to the target size of the ink droplet $Q_{target}$ is repeatedly calculated on the assumption that the size of the ink droplet ejected from the nozzle is linear with respect to the drive voltage, and has a slope the same as a slope of a line 420 of FIG. 4. Since in practice, the relationship between the size of the ink droplet ejected from the nozzle and the drive voltage may be a curve 400, when the drive voltage $V_2$ calculated by the voltage calculator 333 is applied by the power supply 300, an ink droplet of a size approximately corresponding to $Q_{target}$ is ejected and sensed by the ink droplet sensor 310, and the size of the ink droplet is included within the predetermined control range from $Q_{low}$ to $Q_{high}$.

As described above, while the variation rate of the size of the ink droplet may be non-linear with respect to the drive voltage, the nozzle control device illustrated in FIG. 3 may operate on the assumption that the relationship is linear and has a slope like the lines 410 and 420 of FIG. 4.

When the determiner 320 determines that a size $Q_{n,i}$ of the ink droplet (or an ejection speed $S_{n,i}$ of the ink droplet) sensed by the ink droplet sensor 310 is included within the predetermined control range, the drive voltage storage unit 340 stores a value of the drive voltage $V_{n,i}$ applied by the power supply 300 in a storage medium in correspondence with the nozzle $N_n$.

In addition, when the nozzle is examined according to the nozzle drive control method of the present general inventive concept and a print job is performed, the ink droplet is ejected to the print medium and printed by applying the drive voltage stored in the drive voltage storage unit 340 with respect to each nozzle.

The general inventive concept can also be embodied as computer readable codes on a computer (such as a device with information processing function) readable recording medium. The computer readable recording medium is any data storage device that can store data which can be thereafter read by a computer system. Examples of the computer readable recording medium may include read-only memory (ROM), random-access memory (RAM), CD-ROMs, magnetic tapes, hard disks, floppy disks, and optical data storage devices.

According to the nozzle drive control device and method of the present general inventive concept, a size and a speed of an ink droplet ejected from a nozzle can be controlled by repeatedly calculating and controlling a drive voltage of the nozzle.

Figure 5:
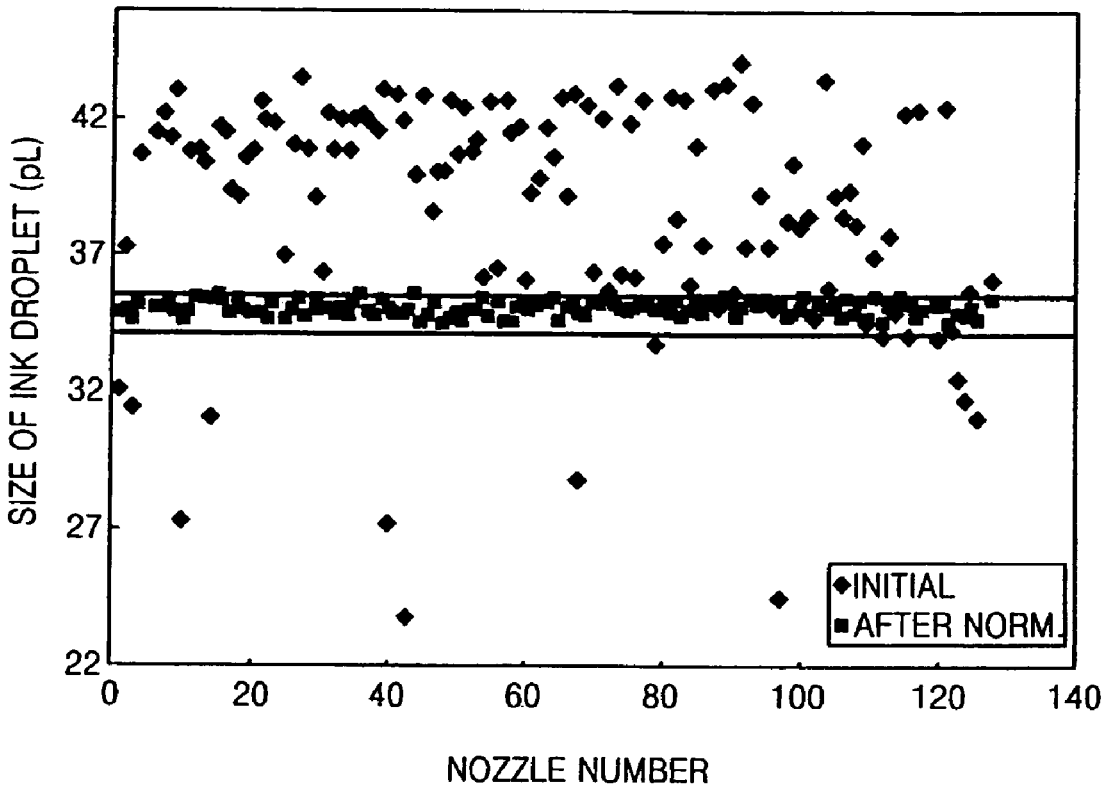
FIG. 5 is a graph illustrating a nozzle drive control device and method according to the present general inventive concept.

According to the present general inventive concept, and as illustrated in FIG. 5, the size and the speed of the ink droplet ejected from the nozzle can be controlled to be constant with respect to the plurality of nozzles included in a print head of an image forming apparatus.

In addition, and according to the present general inventive concept, in the fields of industrial inkjets in which the size and the speed of the ink droplet have to be controlled accurately, examining and correcting the print head can be readily carried out and accurately performed.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A nozzle drive control method comprising:

applying a drive voltage to a nozzle to eject an ink droplet;

sensing a size or an ejecting speed of the ejected ink droplet;

determining whether the sensed size or ejecting speed of the ink droplet is included within a predetermined range; and calculating a second drive voltage as the drive voltage when the sensed size or ejecting speed of the ejected ink droplet is not included within the predetermined range, to apply the second drive voltage to the nozzles to eject a second ink droplet, to sense a second size or second ejecting speed of the second ink droplet as the size or ejecting speed, and to determine whether the size or ejection speed of the second ink droplet is included within the predetermined range, wherein the determining of whether the sensed size or ejecting speed of the ink droplet is included within the predetermined range comprises using predetermined ranges corresponding to respective nozzles in an image forming apparatus having a plurality of nozzles.

2. The method of claim 1, wherein the calculating of the second drive voltage comprises repeating the calculating the second drive voltage as the drive voltage until the sensed result is included within the predetermined range.

3. The method of claim 1, wherein the calculating of the drive voltage comprises calculating the second drive voltage according to a determination that variation rates of the size and the ejecting speed of the ink droplet and the second size and ejection speed of the second ink droplet ejected from the nozzle are linear with respect to the applied drive voltage.

4. The method of claim 3, wherein the calculating of the second drive voltage comprises calculating the second drive voltage using the following equation:

$V_{new}=V_{old}+(Q_{target}-Q_{sensed})/a$, wherein $V_{new}$ is the new drive voltage to be calculated, is a $V_{old}$ is the previously applied drive voltage, $Q_{target}$ is a predetermined size or ejecting speed of the ink droplet, $Q_{sensed}$ is the sensed size or ejecting speed of the ink droplet, and a is a predetermined slope.

5. The method of claim 1, wherein the calculating of the second drive voltage comprises calculating the second drive voltage using a Newton-Rhapson method, false-position method, or a bisection method.

6. The method of claim 1, further comprising:

applying another drive voltage to another nozzle to eject another ink droplet;

sensing another size or ejecting speed of the another ink droplet ejected by the another nozzle;

determining whether the sensed size or ejecting speed of the another ink droplet ejected by the another nozzle is included within a different predetermined range; and calculating a third drive voltage as the another drive voltage when the sensed size or ejecting speed of the another ink droplet ejected by the another nozzle is not included within the different predetermined range, to apply the third drive voltage to the another nozzle to eject a second another ink droplet, to sense a second another size or ejecting speed of the second another ink droplet ejected from the second nozzle as the another size or ejecting speed of the ink droplet ejected by the another nozzle, and to determine whether the size or ejection speed of the second another ink droplet ejected by the another nozzle is included within the different predetermined range.

7. The method of claim 1, further comprising:

storing the applied drive voltage for the nozzle when it is determined that the sensed size or ejecting speed of the ink droplet ejected is included within the predetermined range.

8. The method of claim 7, further comprising:

controlling the nozzle by the stored drive voltage when performing a print job.

9. A computer-readable recording medium having embodied thereon a computer program for executing a nozzle drive control method, the method comprising:

applying a drive voltage to a nozzle to eject an ink droplet;

sensing a size or an ejecting speed of the ejected ink droplet;

determining whether the sensed size or ejecting speed of the ink droplet is included within a predetermined range; and calculating a second drive voltage as the drive voltage when the sensed size or ejecting speed of the ejected ink droplet is not included within the predetermined range, to apply the second drive voltage to the nozzles to eject a second ink droplet, to sense a second size or second ejecting speed of the second ink droplet as the size or ejecting speed, and to determine whether the size or ejection speed of the second ink droplet is included within the predetermined range, wherein the determining of whether the sensed size or ejecting speed of the ink droplet is included within the predetermined range comprises using predetermined ranges corresponding to respective nozzles in an image forming apparatus having a plurality of nozzles.

10. A nozzle drive control device comprising:

a power supply to apply a drive voltage to a nozzle to eject an ink droplet;

an ink droplet sensor to sense a size or an ejecting speed of the ejected ink droplet;

a determiner to determine whether the sensed size or ejecting speed of the ejected ink droplet is included within a predetermined range; and a controller to calculate a second drive voltage as the drive voltage when the determiner determines that the sensed size or ejecting speed of the ejected ink droplet is not included within the predetermined range and to control the power supply, the ink droplet sensor, and the determiner to apply the second drive voltage to the nozzle to eject a second ink droplet, to sense a second size or ejection speed of the second ink droplet, and to determiner whether the size or ejection speed of the second ink droplet is included within the predetermined range, respectively, wherein the determiner comprises predetermined ranges corresponding to respective nozzles in an image forming apparatus having a plurality of nozzles.

11. The device of claim 10, wherein the controller controls the power supply, the ink droplet sensor, and the determiner repeatedly until the determiner determines that the sensed size or ejecting speed of the ejected ink droplet is included within the predetermined range.

12. The device of claim 11, wherein the controller comprises:

a voltage calculator to calculate the second drive voltage to be applied to the nozzle using the sensed size or ejecting speed of the ejected ink droplet; and a repetition controller to repeatedly control the power supply, the ink droplet sensor, and the determiner in accordance with the calculated second drive voltage.

13. The device of claim 12, wherein the voltage calculator calculates the second drive voltage according to a determination that variation rates of the size and the ejecting speed of the ink droplet and the second size and ejecting speed of the second ink droplet ejected from the nozzle are linear with respect to the applied drive voltage.

14. The device of claim 12, wherein the voltage calculator calculates the second drive voltage using the following equation:

$V_{new}=V_{old}+(Q_{target}-Q_{sensed})/a$, wherein $V_{new}$ is a new drive voltage to be calculated, $V_{old}$ is the previously applied drive voltage, $Q_{target}$ is a predetermined size or ejecting speed of the ink droplet, $Q_{sensed}$ is the sensed size or ejecting speed of the ink droplet, and a is a predetermined slope.

15. The device of claim 12, wherein the voltage calculator calculates the second drive voltage using a Newton-Rhapson method, false-position method, or a bisection method.

16. The device of claim 11, further comprising:

a drive voltage storage unit to store the applied drive voltage for the nozzle when the determiner determines that the sensed size or ejecting speed of the ejected ink droplet is within the predetermined range.

17. The device of claim 16, further comprising:

a nozzle controller to control the nozzle by the stored drive voltage when performing a print job.

18. A method to control a nozzle, the method comprising:

applying a drive voltage to the nozzle to eject an ink droplet;

detecting a size or an ejecting speed of the ejected ink droplet;

determining whether the size or ejecting speed of the ejected ink droplet is within a predetermined range; and calculating a new drive voltage as the drive voltage to apply to the nozzle when the determined size or ejecting speed of the ejected ink droplet is not within the predetermined range, and repeating the applying of the new drive voltage, the detecting a size or ejection speed, and the determining of whether the size or ejection speed of the ejected ink droplet is within the predetermined range until the detected size or ejection speed is within the predetermined range, wherein the determining of whether the sensed size or ejecting speed of the ink droplet is included within the predetermined range comprises using predetermined ranges corresponding to respective nozzles in an image forming apparatus having a plurality of nozzles.

* * * * *